US009915414B2

(12) United States Patent
Song et al.

(10) Patent No.: US 9,915,414 B2
(45) Date of Patent: Mar. 13, 2018

(54) LUMINAIRE AND LIGHTING ARRANGEMENT

(71) Applicant: PHILIPS LIGHTING HOLDING B.V., Eindhoven (NL)

(72) Inventors: Gang Song, Eindhoven (NL); Caijie Yan, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/117,459

(22) PCT Filed: Feb. 6, 2015

(86) PCT No.: PCT/EP2015/052459
§ 371 (c)(1),
(2) Date: Aug. 9, 2016

(87) PCT Pub. No.: WO2015/124438
PCT Pub. Date: Aug. 27, 2015

(65) Prior Publication Data

US 2016/0369979 A1 Dec. 22, 2016

(30) Foreign Application Priority Data

Feb. 19, 2014 (WO) ..... PCT/CN2014/000165
May 19, 2014 (EP) ..... 14168762

(51) Int. Cl.
*F21V 9/00* (2015.01)
*F21V 14/04* (2006.01)
(Continued)

(52) U.S. Cl.
CPC ..... *F21V 14/04* (2013.01); *F21S 8/088* (2013.01); *F21V 3/00* (2013.01); *F21V 7/0083* (2013.01);
(Continued)

(58) Field of Classification Search
CPC .... F21Y 2107/30; F21Y 2113/13; F21V 3/00; F21V 14/04; F21V 14/02; F21V 14/08; F21V 7/0083; F21V 17/02; F21S 8/088
(Continued)

(56) References Cited

U.S. PATENT DOCUMENTS 3,937,848 A 2/1976 Campbell et al.
5,711,598 A 1/1998 Tseng
(Continued)

FOREIGN PATENT DOCUMENTS

CN 87208753 U 6/1988
CN 1662772 A 8/2005
(Continued)

OTHER PUBLICATIONS

Eski, 1 page, undated; http://eskistudio.com/projects/kaleidoscope/.

*Primary Examiner* — Laura Gudorf

(57) ABSTRACT

A luminaire (100) comprising a chamber (110) comprising at least one light exit surface (112); an axial carrier (120) mounted in said chamber (110) on an axis (105), said axial carrier (120) carrying a plurality of solid state lighting elements (122) and being surrounded by the light exit surface (112); and a body (130) mounted around said axial carrier (120), said body (130) comprising a plurality of radially extending optical cells (140) each comprising an inlet (142) facing said axial carrier (120); an outlet (144) facing the light exit surface (112); and a plurality of reflective surfaces (146, 148) extending from said inlet (142) to said outlet (144); wherein at least one of the axial carrier (120) and the body (130) are rotatably mounted relative to said axis (105) and wherein the body (130) can be rotated relative to the axcial carrier (120) or vice versa.

15 Claims, 10 Drawing Sheets

(51) Int. Cl.

| | |
|---|---|
| ***F21S 8/08*** | (2006.01) |
| ***F21V 7/00*** | (2006.01) |
| ***F21V 11/02*** | (2006.01) |
| ***F21V 14/02*** | (2006.01) |
| ***F21V 14/08*** | (2006.01) |
| ***F21V 17/02*** | (2006.01) |
| ***F21V 3/00*** | (2015.01) |
| *F21W 131/103* | (2006.01) |
| *F21Y 115/10* | (2016.01) |
| *F21Y 107/30* | (2016.01) |
| *F21Y 113/13* | (2016.01) |

(52) U.S. Cl.
CPC ..... *F21V 11/02* (2013.01); *F21V 14/02* (2013.01); *F21V 14/08* (2013.01); *F21V 17/02* (2013.01); *F21W 2131/103* (2013.01); *F21Y 2107/30* (2016.08); *F21Y 2113/13* (2016.08); *F21Y 2115/10* (2016.08)

(58) Field of Classification Search
USPC ..... 362/231
See application file for complete search history.

(56) References Cited

U.S. PATENT DOCUMENTS

| | | | |
|---|---|---|---|
| 6,336,725 | B1 | 1/2002 | Cianfichi, Jr. |
| 2011/0181959 | A1 | 7/2011 | Clark |
| 2013/0094219 | A1 | 4/2013 | Jurik et al. |

FOREIGN PATENT DOCUMENTS

| | | | |
|---|---|---|---|
| CN | 202815317 | U | 3/2013 |
| EP | 2273185 | A1 | 1/2011 |

LUMINAIRE AND LIGHTING ARRANGEMENT

CROSS REFERENCE TO PRIOR APPLICATIONS

This application is the U.S. National Phase application under 35 U.S.C. § 371 of International Application No. PCT/2015/052459, filed on Feb. 6, 2015, which claims the benefit of European Patent Application No. 14168762.4, filed on May 19, 2014, and Chinese Patent Application No. PCT/CN2014/000165, filed on Feb. 19, 2014. These applications are hereby incorporated by reference herein.

FIELD OF THE INVENTION

The present invention relates to a luminaire, in particular to a luminaire for illuminating an outdoor space in an urban environment such as a post-top luminaire.

The present invention further relates to a lighting arrangement including such a luminaire.

BACKGROUND OF THE INVENTION

Urban landscape lighting such as road lighting, street lighting, square lighting and so on is commonplace in many urban areas to provide illumination of such areas, which for instance is important for safety and security reasons. Many types of luminaires are used for urban landscape lighting, such as for instance post-top lighting, column lighting, bollard lighting and so on.

The functional lighting provided by such luminaries typically has to meet specific regulations in order to ensure that appropriate lighting levels are provided in a safe manner, e.g. by ensuring that glare levels produced by the luminaire are kept below defined thresholds.

Consequently, the design of such luminaires must be suitable to meet the aforementioned specific regulations. At the same time, because such luminaires are placed in urban environments, the appearance of such luminaires is important, for instance because the luminaire preferably has to blend into the environment in which it is placed. In other words, the luminaire preferably should be decorative whilst at the same time providing the required functional lighting in order to ensure that the luminaire is considered a welcome addition to the urban environment in which it is placed.

It has been recognized that the appearance of the luminaire in an urban landscape can be controlled not only by the appearance of the luminaire itself but also by shaping the luminous output of the luminaire. It is for instance is known to adjust the lighting pattern produced by a luminaire upon detection of a person in the vicinity of the luminaire. However, such dynamic variations of the lighting pattern may be beneficial for functional reasons but may not be considered aesthetically pleasing. In addition, the cost of such luminaires is significantly increased due to the requirement of motion detection sensors or the like and appropriate controllers responsive to such sensors that control the luminous output of the luminaire.

It is known per se to provide a lighting fixture that can create an aesthetically pleasing effect such as a kaleidoscopic effect. For instance, U.S. Pat. No. 5,711,598 A discloses a lamp device that includes a light emitting unit for emitting a light beam, a light filtering unit, first and second focusing lenses, and a total internal reflection unit. The light filtering unit has a rotatable glass-holding frame and a pair of flat glasses which are fixed opposedly to the glass-holding frame. A space is formed between the flat glasses to receive damping fluid in which a plurality of colored glass fragments are dispersed. The light filtering unit is positioned adjacent the light emitting unit so that the light beam from the light emitting unit can pass through the flat glasses and the colored glass fragments. The first and second focusing lenses are spaced opposedly from one another. The first focusing lens is positioned adjacent the light filtering unit. The total internal reflection unit is mounted between the first and second focusing lenses so that the light beam from the light filtering unit can be emitted through the first focusing lens, reflected by the total internal reflection unit, and emitted from the second focusing lens, thereby producing a kaleidoscopic light output.

However, such an arrangement is relatively complex and not particularly suitable in an urban lighting environment, for instance if a luminous output may have to be generated in a particular direction to meet functional lighting requirements.

EP2273185A1 discloses a light element with a light diverter which has a elongate carrier element, which is arranged along its peripheral around a longitudinal axis for supporting circuit carriers for light emitting diodes. The elongate carrier element has surface sections along its peripheral around the longitudinal axis. The light diverter has a plurality of segments. However, the light diverter is directly mounted to the elongate carrier element.

SUMMARY OF THE INVENTION

The present invention seeks to provide a luminaire that can create a dynamic aesthetic appearance and that optionally is suitable for use in an urban environment.

The present invention further seeks to provide a lighting arrangement including such a luminaire.

According to an aspect, there is provided a luminaire comprising a chamber comprising at least one light exit surface, an axial carrier mounted in said chamber on an axis, said axial carrier carrying a plurality of solid state lighting elements and being surrounded by the at least one light exit surface; and a body mounted around said axial carrier, said body comprising a plurality of radially extending optical cells each comprising an inlet facing said axial carrier, an outlet facing the at least one light exit surface and a plurality of reflective surfaces extending from said inlet to said outlet, wherein at least one of the axial carrier and the body are rotatably mounted relative to said axis.

By providing a luminaire that includes an axial arrangement of SSL elements and a body comprising a plurality of optical cells for reflecting the luminous output of the SSL elements wherein the body can be rotated relative to the axial carrier or vice versa, a dynamic kaleidoscopic effect can be generated in a relatively simple manner that can improve the appearance of the luminaire such as a post-top luminaire.

The optical cells may be arranged in at least one array, wherein the inlet of each optical cell is smaller than its outlet. The provision of such wedge-shaped optical cells in an array at least partially surrounding the axial carrier is a particularly suitable arrangement for providing such a kaleidoscopic effect.

In particular, the inlets may be dimensioned such that each inlet faces a subset of said plurality of said solid state lighting elements, said subset comprising at least two solid state lighting elements. By mixing the luminous output of multiple SSL elements in each optical cell, more complex kaleidoscopic effects may be generated by the luminaire. To this end, each optical cell may radially extend over a distance such that the plurality of reflective surfaces reflects incident light from said subset multiple times between said inlet and said outlet in order to establish effective superposition of the luminous output or images of the multiple SSL elements of said subset.

In an embodiment, the body comprises a plurality of said arrays in a stack to facilitate the generation of a particularly elaborate kaleidoscopic effect.

Each array may comprise N optical cells, N being a positive integer of at least 12, wherein each of said N optical cells comprises a first reflective side wall radially extending from the inlet to the outlet in a first direction; and a second reflective side wall radially extending from the inlet to the outlet in a second direction, wherein an angle between the first direction and the second direction is 360°/N. By selecting an angle between the first direction and the second direction of no more than 30°, it is ensured that each optical cell reflects the incident light of the one or more SSL elements multiple times, thereby providing the desired kaleidoscopic effect. Preferably, N is at least 24.

In an embodiment, at least some of the outlets comprise a diffusive cover. This allows for the kaleidoscopic effect to be projected onto the diffusive cover such that the kaleidoscopic effect can be observed when looking at the luminaire, whereas light passing through the diffusive cover and exiting the luminaire through the at least one light exit surface is diffused, such that a substantially homogeneous luminous output may be generated outside the luminaire. This is particularly relevant if the luminaire is a post-top luminaire for use in an urban environment, where the luminaire may be required to generate a functional luminous distribution that has to meet certain requirements.

In an embodiment, the plurality of reflective surfaces includes an upper reflective surface and a lower reflective surface that are angled downwardly in the direction from the inlet to the outlet of said optical cell. This ensures that the light generated by the SSL elements is angled downwardly in normal use of the luminaire, which for instance ensures that the luminaire may be used as a post-top luminaire.

The upper reflective surface and the lower reflective surface may be angled in a range from 15-60° relative to a plane normal to said axis to redirect the luminous output of the SSL elements in an appropriate direction.

The luminaire may further comprise an electromotor coupled to said body or axial carrier for rotating said body or axial carrier relative to said axis.

In an embodiment, the body is rotatable relative to the axial carrier, the luminaire further comprising a pair of annular bearings affixing the body to the axial carrier. This ensures that the body is securely mounted and allowed to freely rotate around the axial carrier.

The plurality of solid state lighting elements may comprise solid state lighting elements emitting different colours, wherein the respective inlets of different optical cells face solid state lighting elements emitting different colours. This for instance facilitates the generation of different colour patterns by different optical cells, which can enhance the kaleidoscopic effect created by the luminaire.

The SSL elements may be arranged on the axial carrier in any suitable pattern. A particularly suitable pattern is a linear pattern of said solid state lighting elements, wherein each line of said linear pattern extends parallel to said axis.

According to a further aspect, there is provided a lighting arrangement comprising the luminaire according to one of the aforementioned embodiments and a mounting post, wherein the luminaire is mounted on said mounting post. Such a lighting arrangement may for instance be used in an urban environment to create an aesthetically pleasing lighting arrangement that also may be capable to generate a required functional lighting pattern.

BRIEF DESCRIPTION OF THE DRAWINGS

Embodiments of the invention are described in more detail and by way of non-limiting examples with reference to the accompanying drawings, wherein FIG. 1 schematically depicts a cross-sectional top view of a luminaire according to an embodiment of the present invention.

DETAILED DESCRIPTION OF THE EMBODIMENTS

Figure 1:
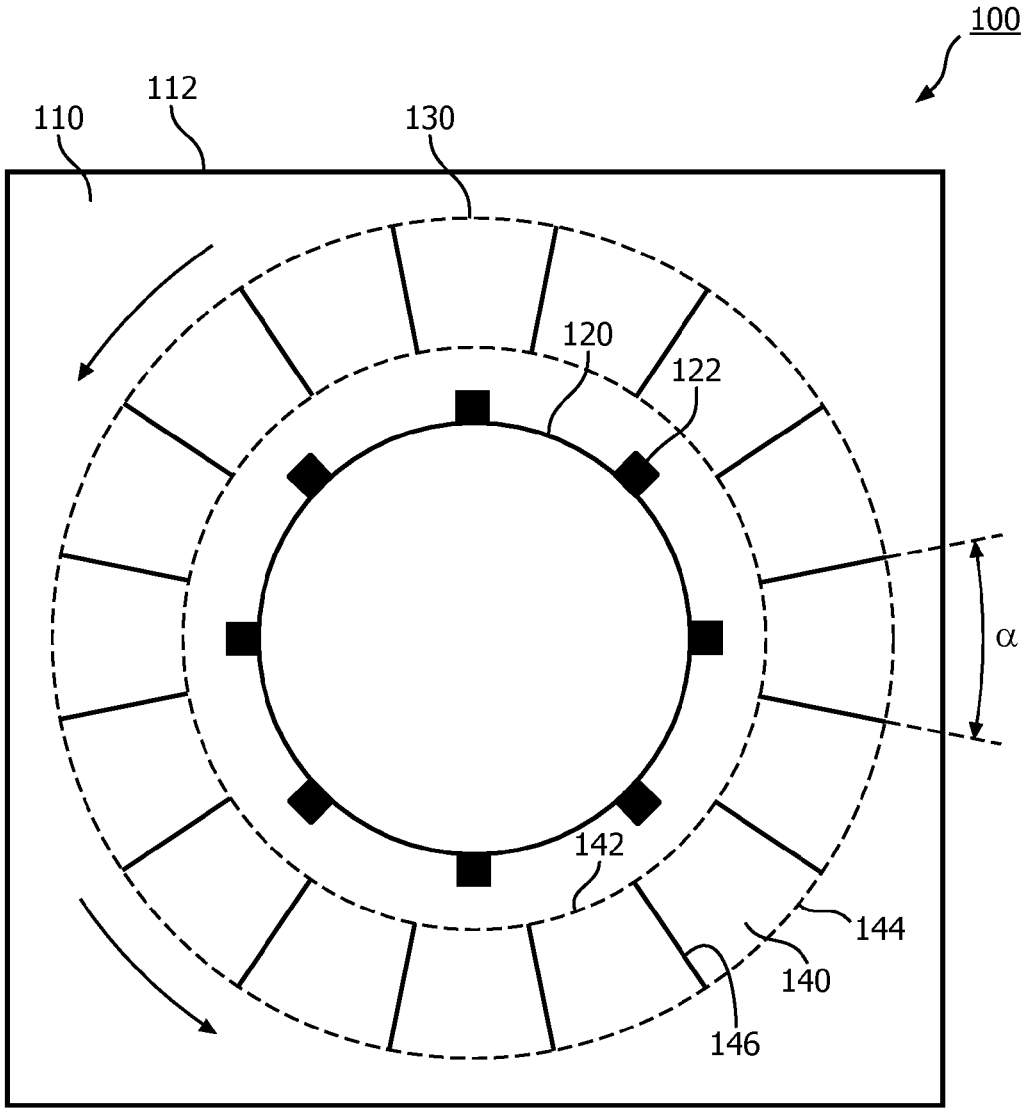

It should be understood that the Figures are merely schematic and are not drawn to scale. It should also be understood that the same reference numerals are used throughout the Figures to indicate the same or similar parts.

Figure 2:
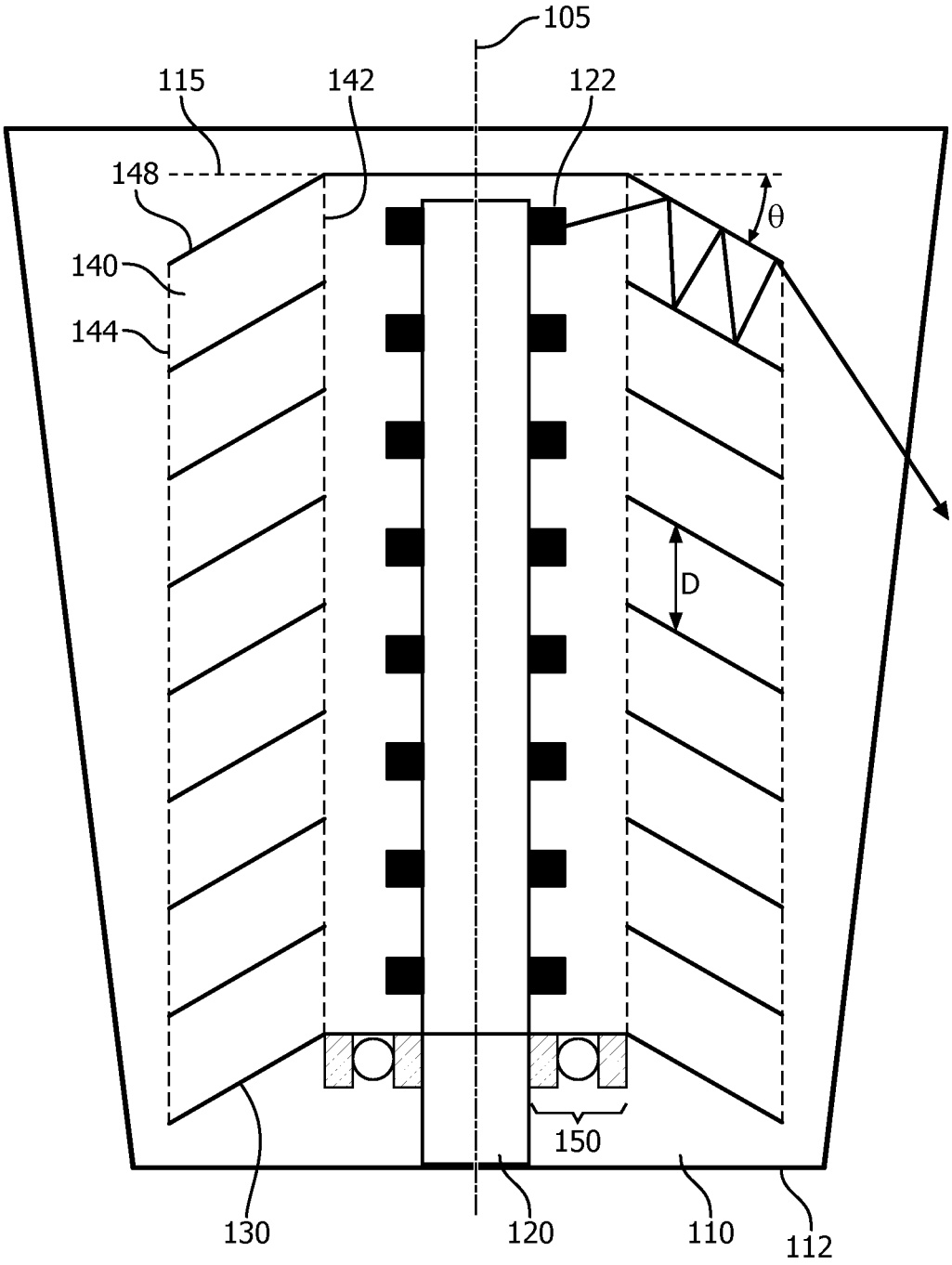
FIG. 2 schematically depicts a cross-sectional side view of a luminaire according to an embodiment of the present invention.

FIG. 1 schematically depicts a top view of an aspect of a luminaire 100 according to an embodiment of the present invention, whereas FIG. 2 schematically depicts a cross-section of the luminaire 100 shown in FIG. 1. The luminaire 100 comprises a chamber 110 that is delimited by at least one light exit surface 112. The number of light exit surfaces 112 is typically determined by the shape of the luminaire 100; in FIG. 1 the chamber 110 is delimited by four light exit surfaces 112, i.e. the luminaire 100 has four sides. However, it should be understood that this is by way of non-limiting example only and that the luminaire 100 may have any suitable number of light exit surfaces 112; e.g. a single light exit surface 112 in case of a cylindrical or frustoconical luminaire 100, three light exit surfaces 112 in case of a triangular luminaire 100, four or more light exit surfaces 112 in case of a more complex polyhedral luminaire 100 and so on. The light exit surfaces 112 may be made of any suitable material, such as glass or a suitable optical grade polymer such as polycarbonate (PC), polyethylene terephthalate (PET), poly(methyl methacrylate) (PMMA) and so on. In an embodiment, the light exit surfaces 112 are optically transmissive, e.g. are transparent, for instance having a transparency of more than 80% or even more than 90% if it is desirable that the multiple images of the SSL elements 122 generated by the internals of the chamber 110 are clearly visible from outside the luminaire 100.

The chamber 110 houses an axial carrier 120, which axial carrier 120 carries a plurality of solid state lighting (SSL) elements 122. The SSL elements 122 may be arranged in any suitable pattern on the axial carrier 120. In an embodiment, the axial carrier 120 carries a plurality of SSL elements 122 arranged in linear patterns, i.e. a plurality of lines of SSL elements 122, with each line extending in parallel with a central axis 105 of the luminaire 100. The axial carrier 120 typically is mounted on the central axis 105. The SSL elements 122 may be light emitting diodes (LEDs). Any suitable LED, such as a LED having an organic or inorganic semiconductor layer, may be used as an SSL element 122.

As will be explained in more detail later, the axial carrier 120 may carry SSL elements 122 that create respective luminous outputs of different color. The axial carrier 120 may be made of any suitable material, such as a thermally conductive material such that the axial carrier 120 can also act as a heat sink for the SSL elements 122. For instance, the axial carrier 120 may be made of a suitable metal such as aluminium although other suitable materials will be immediately apparent to the person skilled in the art, such as other metals, metal alloys, e.g. aluminium alloys, ceramic materials, and so on.

The luminaire 100 further includes a body 130 mounted around the axial carrier 120. The body 130 comprises a plurality of optical cells 140 each having an opening acting as an inlet 142 that faces the axial carrier 120 and the SSL elements 122 mounted thereon and an opening acting as an outlet 144 that faces the at least one light exit surface 112 of the luminaire 100. Each optical cell 140 comprises a first pair of reflective surfaces 146 and a second pair of reflective surfaces 148 each extending between the inlet 142 and the outlet 144 of the optical cell 140, wherein the first pair of reflective surfaces 146 defines the side surfaces of each optical cell 140 and the second pair of reflective surfaces 148 defines the top and bottom surface of each optical cell 140. The body 130 is arranged to create a kaleidoscopic effect by replicating the image or luminous distribution produced by the SSL elements 122 multiple times and to direct the created kaleidoscopic effect towards a target area.

The body 130 may be made of a reflective material such that the reflective surfaces 146 and 148 form an integral part of the body 130. Alternatively, the body 130 may be made of any other suitable material, e.g. a suitable plastic, wherein a reflective film covers the inner walls of each of the optical cells 140 in order to define the respective reflective surfaces 146 and 148. A non-limiting example of a suitable reflective material is the MIRO product family provided by Alanod GmbH and Co. KG. Such a reflective material has a reflectivity in excess of 95% such that the majority of light generated by the SSL elements 122 that enters an optical cell 140 is produced as luminous output by the optical cell 140 despite the optical cell 140 reflecting the incident light several times on the reflective surfaces 146, 148 to achieve the desired kaleidoscopic effect. Other suitable reflective films are known per se and will be apparent to the skilled person.

Each optical cell 140 radially extends from the axial carrier 120 towards the at least one light exit surface 112, wherein a plurality of optical cells 140 may combine to form an annular array of optical cells 140. Consequently, each optical cell 140 may have a wedge shape, i.e. taper outwardly in the direction of the at least one light exit surface 112, such that the inlet 142 of each optical cell 140 is smaller than its outlet 144.

In a particularly advantageous embodiment, the reflective side surfaces 146 of each cell in such an array are placed under an angle $\alpha$ relative to each other, wherein the angle $\alpha$ is chosen such that incident light originating from one or more of the SSL elements 122 entering an optical cell through its inlet 142 is reflected multiple times between the various reflective surfaces 146, 148 of the optical cell 140 before the light exits the optical cell 140 through its outlet 144. In other words, a first one of the reflective surfaces 146 extends from the inlet 142 to an outlet 144 in a first direction, whereas the other one of the reflective surfaces 146 extends from the inlet 142 to an outlet 144 in a second direction, with $\alpha$ being the angle between the first direction and the second direction. This ensures that the incident image originating from one or more of the SSL elements 122 is replicated and intermixed several times, thereby creating the desired kaleidoscopic effect.

Preferably, $\alpha \leq 30°$. More preferably, $\alpha \leq 15°$. In other words, for a body 130 comprising at least one array of N optical cells 140, wherein N is a positive integer, $N \geq 12$ or more preferably $N \geq 24$ as the angle $\alpha$ is defined as $360°/N$ for an (annular) array comprising N identical optical cells 140.

The body 130 may comprise a plurality of such arrays of optical cells 140, which arrays may be stacked along the central axis 105 as shown in FIG. 2. The number of such arrays is not particularly critical and it suffices to say that the body 130 may comprise any suitable number of arrays of optical cells 140 in such a stack.

The body 130 may be rotatably mounted relative to the axial carrier 120 such that the body 130 can spin around the axial carrier 120 as shown by the arrows in FIG. 1. To this end, the body 130 may be mounted in any suitable manner inside the chamber 110. For instance, the body 130 may be mounted to the axial carrier 120 using one or more ball bearings 150 such that the axial carrier 120 supports the body 130 whilst the body 130 can freely rotate around the axial carrier 120, thereby creating a dynamic kaleidoscopic effect due to the fact that the orientation of the optical cells 140 relative to the SSL elements 122 changes over time, thereby changing the kaleidoscopic pattern generated by the optical cells 140. It should be understood that the particular mounting arrangement shown in FIG. 1 is by way of non-limiting example only and that the body 130 may be rotatably mounted inside the chamber 110 in any suitable manner. The luminaire 100 may further comprise an electromotor (not shown) for driving the rotation of the body 130. As will be appreciated by the skilled person, the electromotor may be coupled to the body 130 in any suitable manner. As such coupling mechanisms are well-known per se, they will not be disclosed in further detail for the sake of brevity only.

Moreover, it should be realized that it is equally feasible to fixate the body 130 in the chamber 110 and provide a rotatable axial body 120 instead, which rotates around the central axis 105 in order to change the orientation of the SSL elements 122 relative to the optical cells 140 of the body 130 by way of rotation. In yet another embodiment, both the axial body 120 and the body 130 may be independently rotatable around the central axis 105 to provide the aforementioned dynamic kaleidoscopic effect.

In an embodiment, the luminaire 100 is a post-top luminaire for use in an urban environment, e.g. as a street lamp or the like. In such an embodiment, it may be desirable that the luminous output of the SSL elements 122 is redirected in a downward direction by the optical cells 140 in order to provide a luminous distribution in a ground-level area around the post-top luminaire. To this end, the second pair of reflective surfaces 148 of the optical cells 140 may be angled under an angle θ relative to a virtual plane 115 that is normal (i.e. oriented perpendicularly) to the central axis 105 of the luminaire 100. In an embodiment, the angle θ may be chosen in a range of 15-60° in order to achieve a desired redirection of the luminous output produced by the SSL elements 122.

In at least some embodiments, at least some of the outlets 144 may be covered by a diffusive cover such as a diffusive film (not shown) such that the kaleidoscopic effect is generated by the corresponding optical cell 140 on the diffusive cover. This is for instance advantageous in embodiments where the luminaire 100 has to produce functional lighting in addition to the desired kaleidoscopic aesthetic effect, for instance where the luminaire 100 is used as a post-top luminaire. The diffusive cover, e.g. the diffusive film, ensures that the light that exits the respective outlets 144 through the diffuser is diffused (mixed) such that a (substantially) homogeneous luminous output may be produced outside the luminaire 100 whilst producing a kaleidoscopic pattern inside the luminaire 100 as previously explained.

Consequently, the luminaire 100 may produce a functional luminous distribution in an area surrounding the luminaire whilst providing an aesthetic appearance to an observer directly observing the luminaire 100. In this embodiment, preferably all the outlets 144 of the body 130 are covered by such a diffusive cover. Any suitable diffusive cover may be used, such as a translucent diffusive film, which may be made of any suitable translucent material, such as a polymer, e.g. PC, PET, PMMA or the like, which polymers can be manufactured as transparent or translucent optical grade polymers as is known per se to the skilled person.

Figure 3:
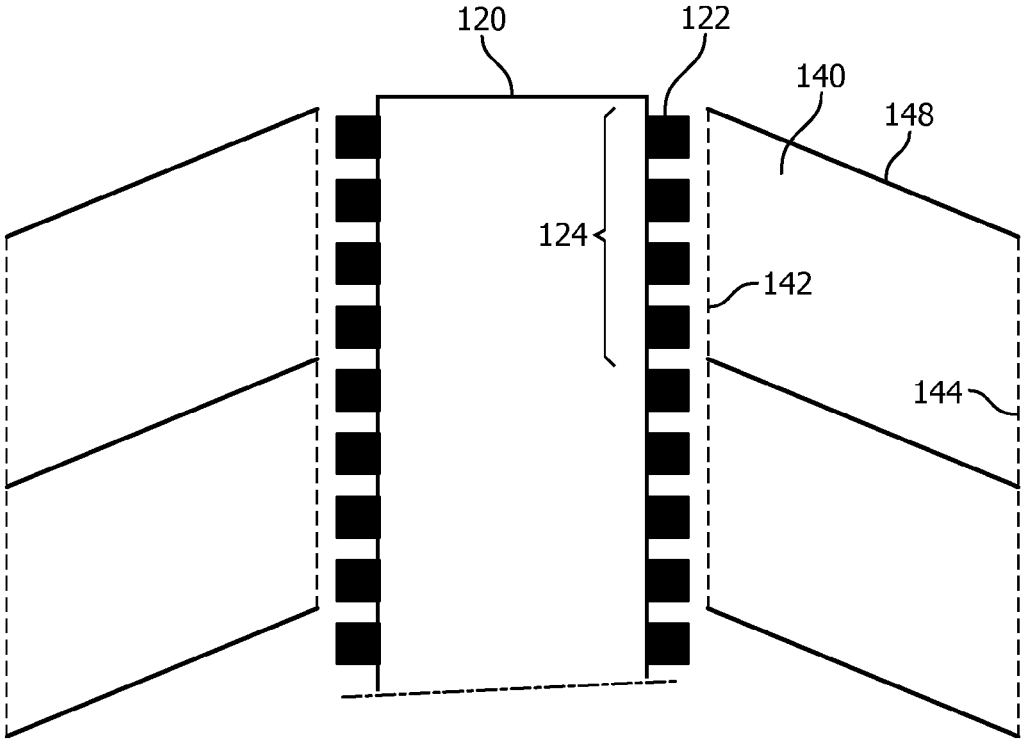
FIG. 3 schematically depicts an aspect of FIG. 2 in more detail.

At this point, it is noted that in FIG. 2 each optical cell 140 is shown to be associated with a single SSL element 122, i.e. receives incident light from a single SSL element 122, for reasons of clarity only. It should be understood that in at least some embodiments, the inlet 142 of an optical cell 140 faces a multitude of SSL elements 122 as is shown by way of non-limiting example in FIG. 3, which schematically depicts a cross-section of an aspect of a luminaire 100, particularly part of the axial carrier 120 carrying a plurality of SSL elements 122 and part of the body 130 (two arrays of optical cells 140). Each of the optical cells 140 is associated with a number of SSL elements 122 on the axial carrier 120, that is each inlet 142 faces a subset 124 of M SSL elements 122, wherein M is a positive integer having a value of at least 2 (M≥2). In FIG. 3, M=4 by way of non-limiting example; it should be understood that each inlet 142 may face any suitable number of SSL elements 122 in order to achieve the desired kaleidoscopic effect, e.g. by creating overlapping images of the multiple SSL elements 122 in a single subset 124 through multiple reflections of said images inside the optical cell 140 as previously explained. FIG. 3 further shows the upper and lower reflective surfaces 148 extending between the inlet 142 and the outlet 144 of the optical cells 140.

In an embodiment, a subset 124 of SSL elements 122 may include SSL elements 122 that generate light of different colours such that the kaleidoscopic effect generated by the optical cell 140 associated with a subset 124 comprises a multitude of colours, which can be particularly aesthetically pleasing. Different subsets 124 may contain SSL elements 122 of different colours, that is different subsets 124 may produce different colour combinations such that upon rotation of the body 130 and/or the axial carrier 128 colour pattern is generated that varies as a result of said rotation. In other words, the luminaire 100 may comprise a plurality of subsets 124 of SSL elements 122 including a first subset 124 comprising P SSL elements 122 generating a first set of colours and a second subset 122 comprising Q SSL elements 122 generating a second set of colours, wherein P and Q each are positive integers that may be equal or different to each other and each have a value of at least 2, and wherein the first set is different to the second set. Preferably, P=Q.

Figure 4:
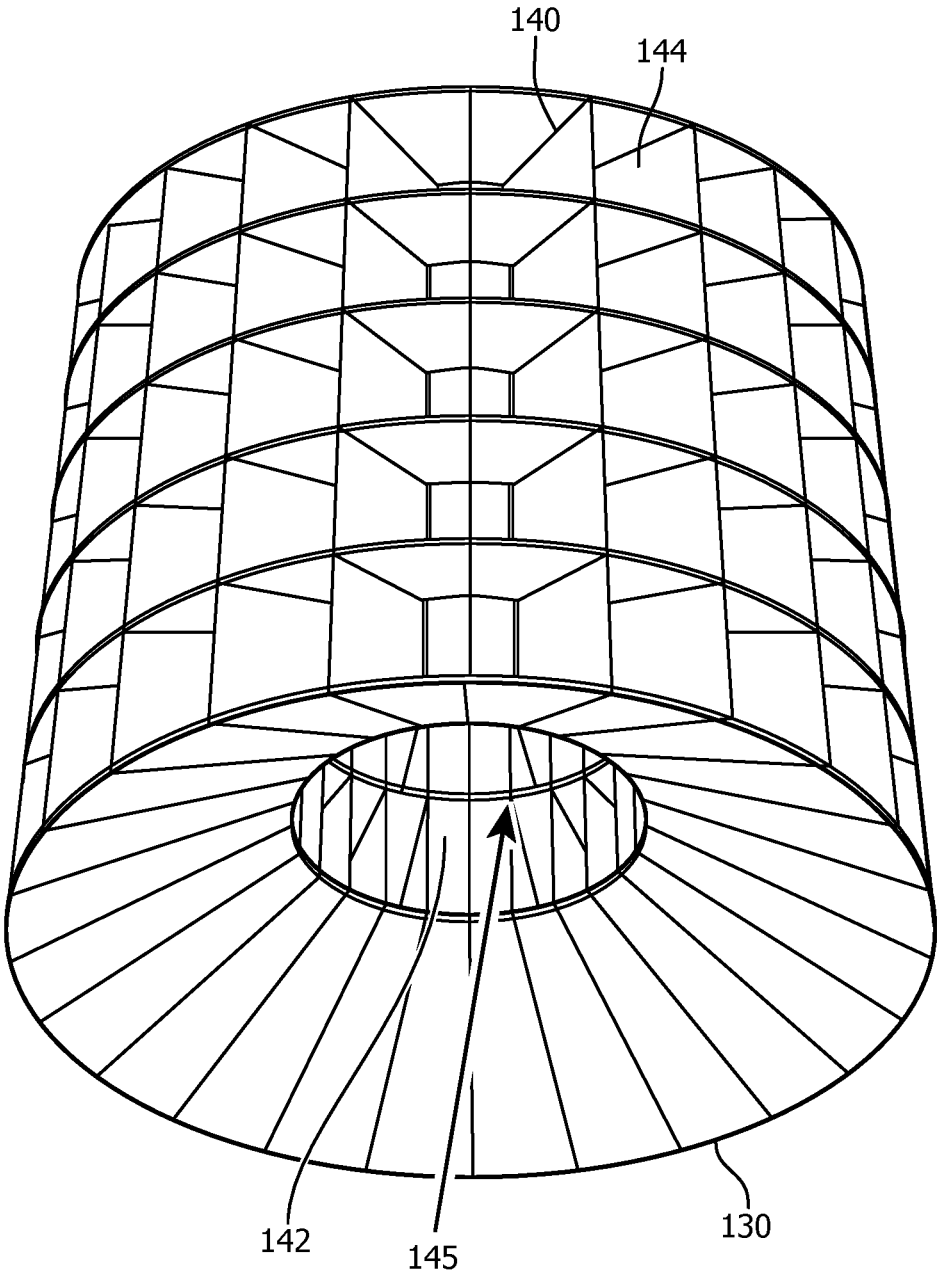
FIG. 4 schematically depicts a first perspective view of a kaleidoscopic body for use in a luminaire according to an embodiment of the present invention.
Figure 5:
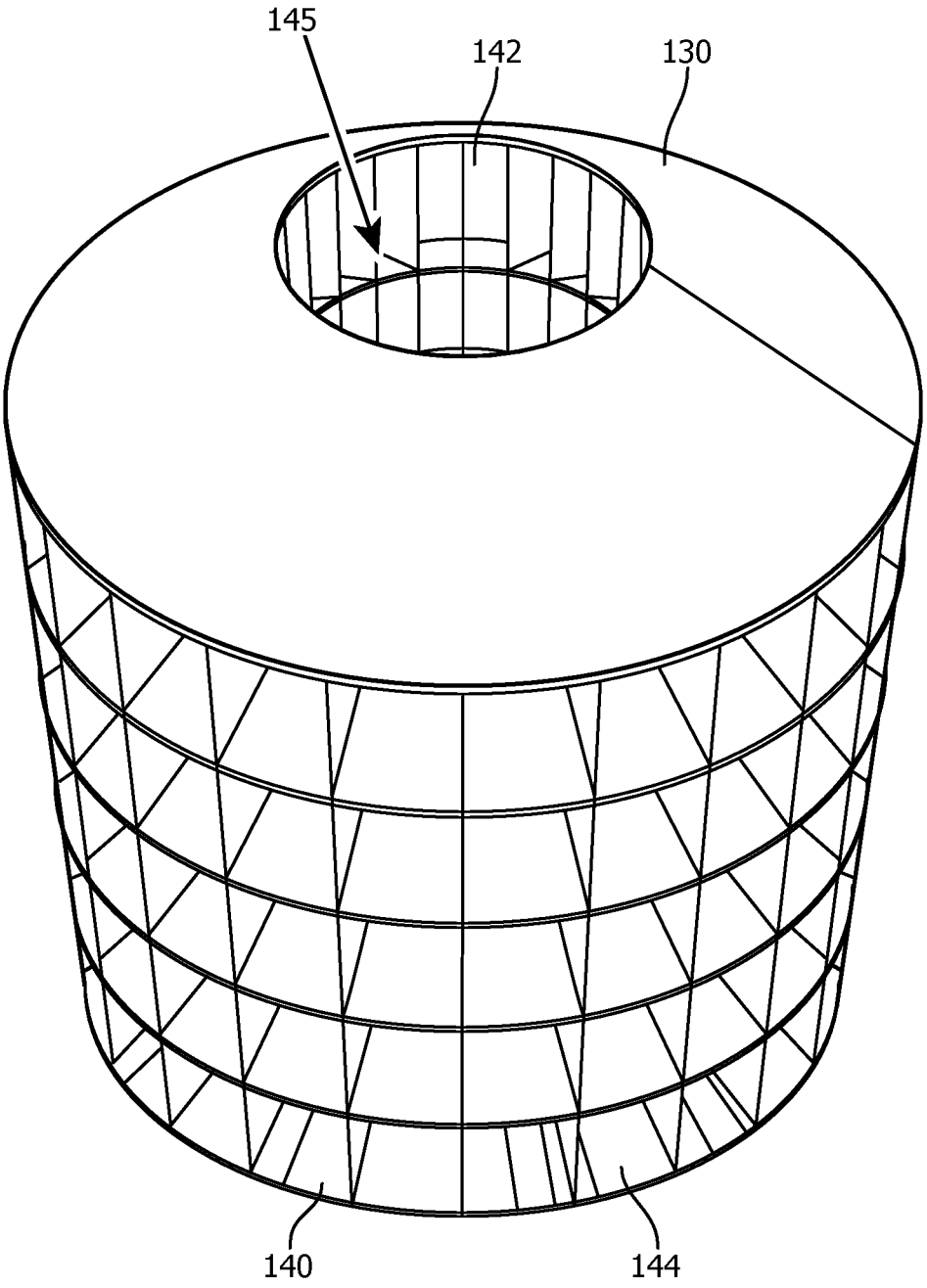
FIG. 5 schematically depicts a further perspective view of a kaleidoscopic body for use in a luminaire according to an embodiment of the present invention.

FIG. 4 schematically depicts a perspective bottom view and FIG. 5 schematically depicts a perspective view of an annular body 130 comprising a stack of annular arrays of wedge-shaped optical cells 140 each extending between inlets 142 facing the aperture 145 of the annular body 130 and outlets 144 in the outer surface of the annular body 130. The aperture 145 is dimensioned such that the axial body 120 including the SSL elements 122 fits inside the aperture 145.

Figure 6:
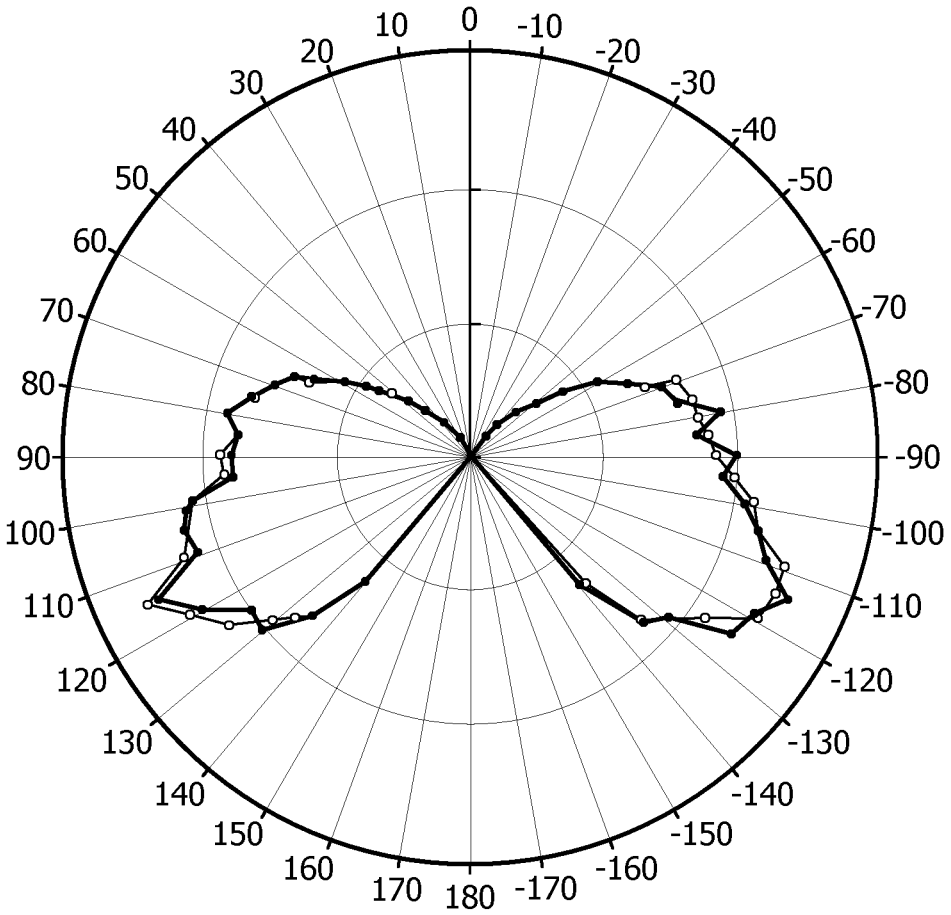
FIG. 6 is a light distribution plot generated by a luminaire according to an embodiment of the present invention.
Figure 7:
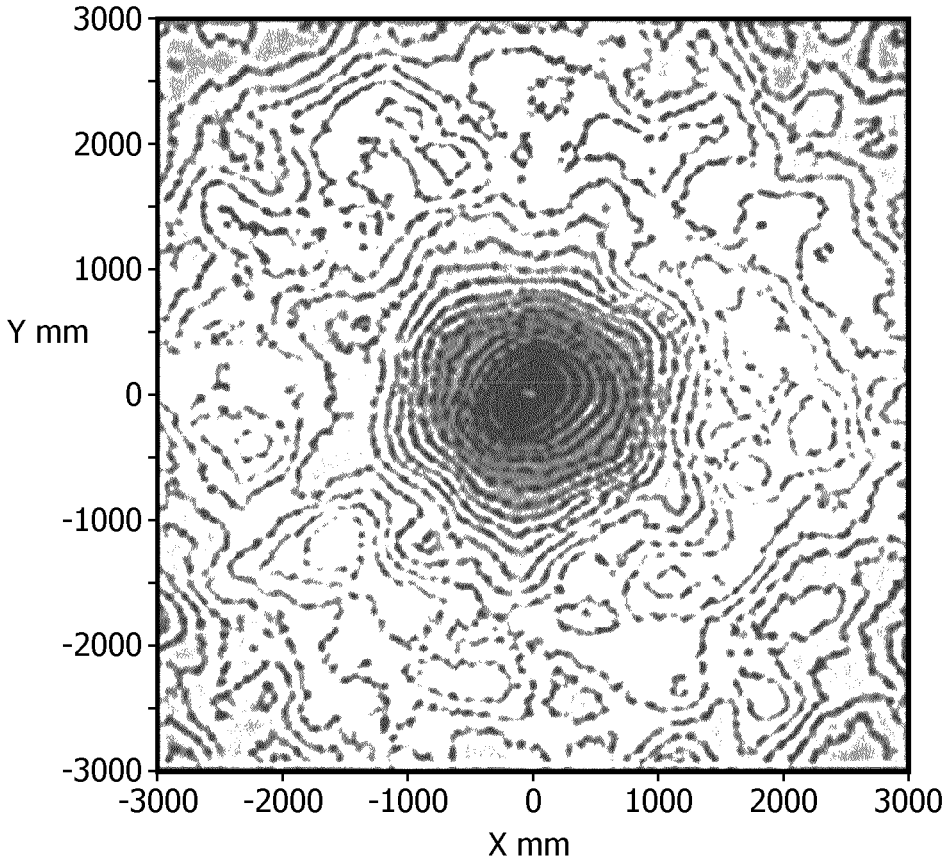
FIG. 7 is a kaleidoscope effect generated by a luminaire according to an embodiment of the present invention.

FIG. 6 depicts a simulated luminous intensity distribution produced by the luminaire 100 at ground level when used as a post-top luminaire mounted at 3 m height. The wattage produced by the SSL elements 122 is about 36 W, and the angle θ is set to 30°. Each of the outlets 144 are covered by a diffusive film. FIG. 7 depicts the simulated kaleidoscopic effect produced by this luminaire 100 on the diffusive cover over the outlets 144. These simulations clearly demonstrate that a luminaire 100 according to embodiments of the present invention can be used as a post-top luminaire for urban landscape lighting, as the required functional luminous distribution can be produced at ground level as shown in FIG. 6, whilst at the same time producing an aesthetically pleasing lighting effect inside the luminaire 100. It is however noted that it is equally feasible that the luminaire 100 is used to generate a kaleidoscopic effect only, in which case the diffusive film of the outlets 144 may be omitted as previously explained. Such a luminaire may be used in any suitable setting, e.g. as a decorative light source indoors or outdoors.

At this point, it is noted that in the previous figures the axial carrier 120 and the annular body 130 have been shown as having a circular circumference by way of non-limiting example only. It should be understood that the axial carrier 120 and/or the body 130 may have any suitably shaped circumference, e.g. a polyhedral circumference such as a hexagonal or octagonal circumference and so on. It should furthermore be understood that although the axial carrier 120 and the body 132 may have matching surface shapes, this is not essential.

Figure 8:
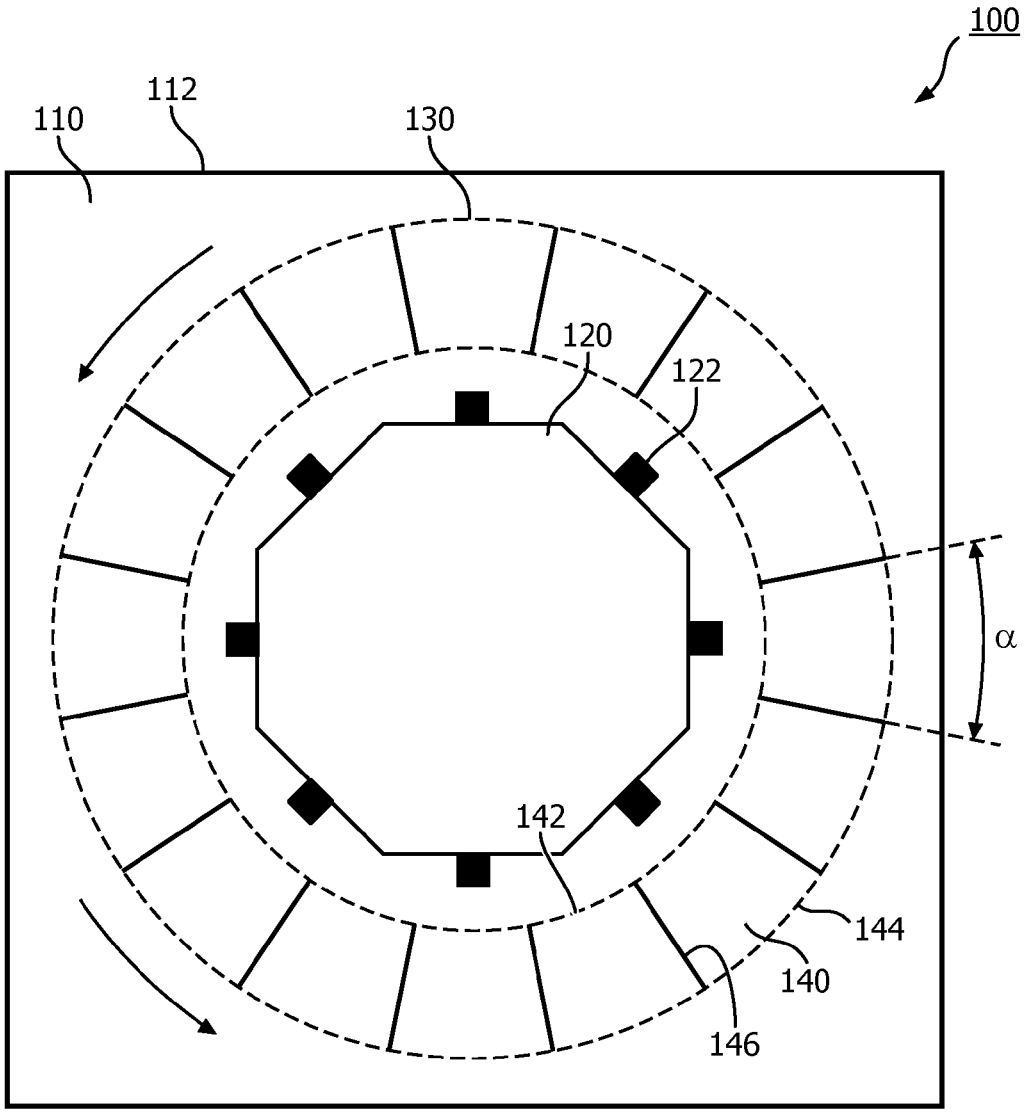
FIG. 8 schematically depicts a cross-sectional top view of a luminaire according to another embodiment of the present invention.

A non-limiting example of a luminaire 100 comprising an axial carrier 120 having a different shape than the body 130 in the chamber 110 is shown in FIG. 8, which schematically depicts a top view of an aspect of such a luminaire 100. The axial body 120 has an octagonal shape in which the SSL elements 122 are organised in a plurality of lines, with each line of SSL elements 122 mounted on one of the facets of the octagonal circumference of the axial carrier 122. The body 130 may be an annular body comprising a circular circumference as previously described with the aid of FIG. 1-5 such that this body will not be described in detail again for the sake of brevity only.

Figure 9:
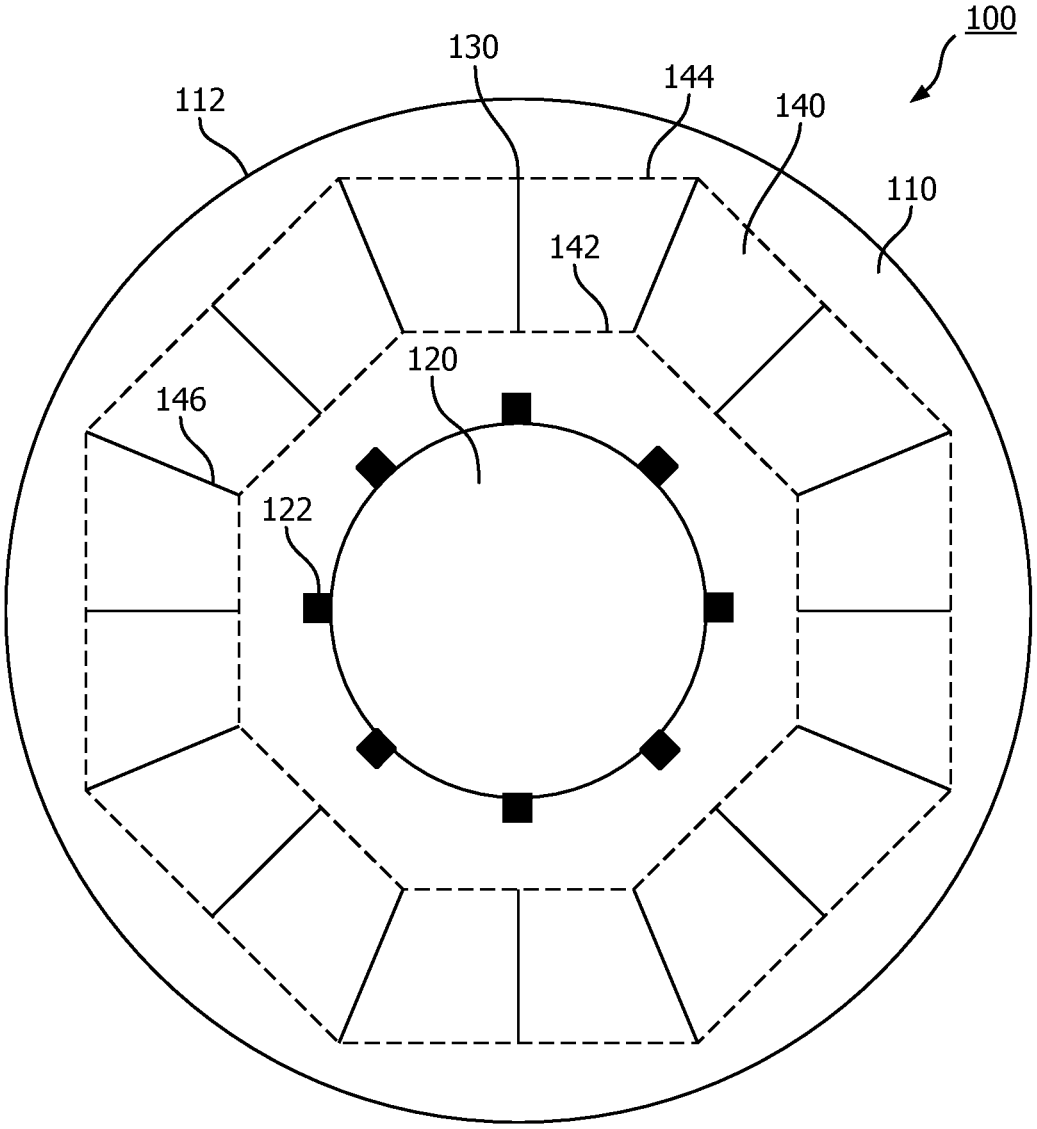
FIG. 9 schematically depicts a cross-sectional top view of a luminaire according to yet another embodiment of the present invention.

Another non-limiting example of a luminaire 100 comprising an axial carrier 120 having a different shape than the body 130 in the chamber 110 is shown in FIG. 9, which schematically depicts a top view of an aspect of such a luminaire 100. The axial carrier 120 has a circular circumference as previously described with the aid of FIG. 1-5 such that the axial carrier 120 will not be described in further detail for the sake of brevity only. In contrast, the body 130 has an octagonal shape such that a subset of the plurality of optical cells 140 defines one of the facets of the body 130. More specifically, the inner octagonal surface of the body 130 is defined by the respective inlets 142 and the outer octagonal surface of the body 130 is defined by the respective outlets 144, with the respective reflective surfaces of the optical cells 140 including the reflective side surfaces 146 extending from the inlets 142 to the outlets 144 as before.

The non-limiting examples shown in FIG. 8 and FIG. 9 are just a few examples of the many suitable shapes of the axial carrier 120 and the body 130 that are immediately apparent to the skilled person and it should be understood that any suitable shape of the axial carrier 120 and the body 130 may be contemplated in the context of the present invention.

Figure 10:
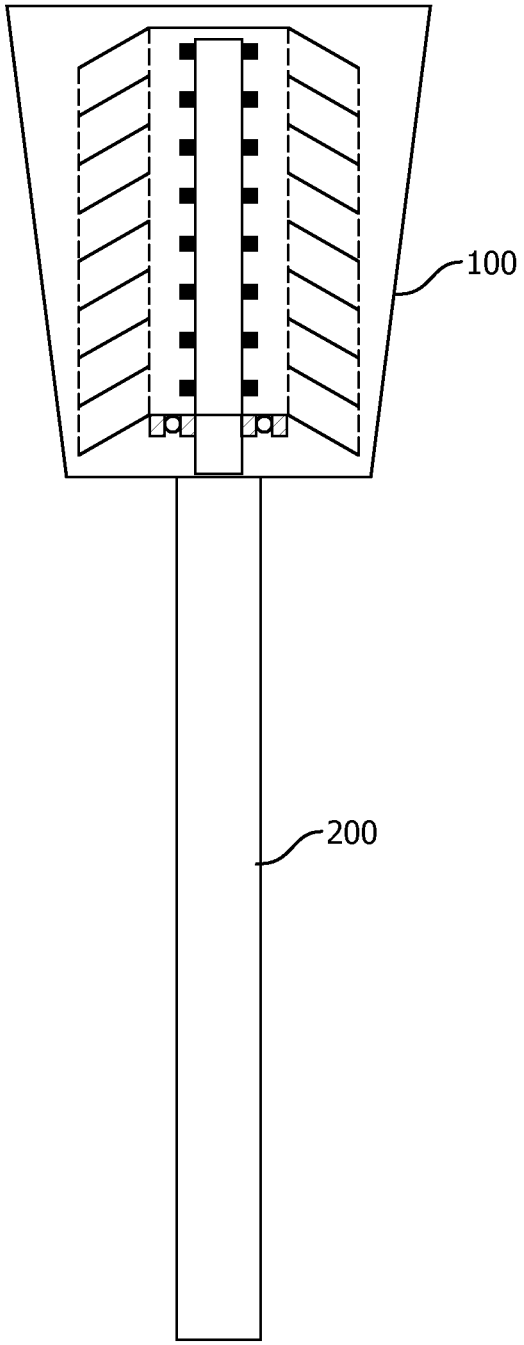
FIG. 10 schematically depicts a cross-sectional side view of a lighting arrangement including a post-top luminaire according to an embodiment of the present invention.

FIG. 10 schematically depicts a lighting arrangement according to an embodiment in which a luminaire 100 is mounted on a mounting post 200. Such a mounting post may be made of any suitable material, e.g. a metal or metal alloy such as steel, and may for instance house the electrical cabling for connecting the luminaire 100 to a power supply. As will be readily understood by the skilled person, the mounting post 200 may be dimensioned such that the lighting arrangement including the luminaire 100 and the mounting post 200 complies with urban lighting requirements, e.g. that the luminaire 100 is positioned such that it generates a luminous distribution of required dimensions in an area such as a road, street, pavement, square, parking lot and so on.

In FIG. 10, the mounting post 200 is connected to a bottom portion of the luminaire 100 by way of non-limiting example. It will be immediately understood by the skilled person that the mounting post 200 may have any suitable shape, e.g. an inverted L-shape, and may be connected to any suitable portion of the luminaire 100, e.g. a top portion of the luminaire 100 such that the luminaire is seen to dangle from the mounting post 200. Many variations to such arrangements are available such that it suffices to say that the luminaire 100 may be attached in any suitable manner to any suitably shaped mounting post 200.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire comprising:

a chamber comprising at least one light exit surface;

an axial carrier mounted in said chamber on an axis, said axial carrier carrying a plurality of solid state lighting elements and being surrounded by the at least one light exit surface; and a body mounted around said axial carrier, said body comprising a plurality of radially extending optical cells each comprising:

an inlet facing said axial carrier;

an outlet facing the at least one light exit surface; and a plurality of reflective surfaces extending from said inlet to said outlet;

wherein at least one of the axial carrier and the body are rotatably mounted relative to said axis;

wherein the body rotates relative to the axial carrier or vice versa.

2. The luminaire of claim 1, wherein the optical cells are arranged in at least one array, wherein the inlet of each optical cell is smaller than the outlet.

3. The luminaire of claim 1, wherein said inlets are dimensioned such that each inlet faces a subset of said plurality of said solid state lighting elements, said subset comprising at least two solid state lighting elements.

4. The luminaire of claim 3, wherein each optical cell radially extends over a distance such that the plurality of reflective surfaces reflects incident light from said subset multiple times between said inlet and said outlet.

5. The luminaire of claim 2, wherein the body comprises a plurality of said arrays in a stack.

6. The luminaire of claim 2, wherein each array comprises N optical cells, N being a positive integer of at least 12, wherein each of said N optical cells comprises:

a first reflective side wall radially extending from the inlet to the outlet in a first direction; and a second reflective side wall radially extending from the inlet to the outlet in a second direction;

wherein an angle ($\alpha$) between the first direction and the second direction is 360°/N.

7. The luminaire of claim 6, wherein N is at least 24.

8. The luminaire of claim 1, wherein at least some of the outlets comprise a diffusive cover.

9. The luminaire of claim 1, wherein the plurality of reflective surfaces includes an upper reflective surface and a lower reflective surface that are angled downwardly in the direction from the inlet to the outlet of said optical cell.

10. The luminaire of claim 9, wherein the upper reflective surface and the lower reflective surface are angled in a range from 15-60° relative to a plane normal to said axis.

11. The luminaire of claim 1, further comprising an electromotor coupled to said body or axial carrier for rotating said body or axial carrier relative to said axis.

12. The luminaire of claim 1, wherein the luminaire further comprising a pair of annular bearings affixing the body to the axial carrier.

13. The luminaire of claim 1, wherein the plurality of solid state lighting elements comprises solid state lighting elements emitting different colours, wherein the respective inlets of different optical cells face solid state lighting elements emitting different colours.

14. The luminaire of claim 1, wherein the axial carrier comprises a linear pattern of said solid state lighting elements, wherein each line of said linear pattern extends parallel to said axis.

15. A lighting arrangement comprising the luminaire of claim 1 and a mounting post, wherein the luminaire is mounted on said mounting post.

* * * * *